United States Patent [19]

Muroi et al.

[11] Patent Number: 4,559,060

[45] Date of Patent: Dec. 17, 1985

[54] UPGRADING METHOD OF LOW-RANK COAL

[75] Inventors: Katsumi Muroi; Akio Yamamoto; Yoichi Nakamura; Toshihiko Takahashi, all of Kudamatsu; Morihisa Maruko, Shimoinayoshi, all of Japan

[73] Assignee: Hitachi, Ltd., Tokyo, Japan

[21] Appl. No.: 534,289

[22] Filed: Sep. 21, 1983

[30] Foreign Application Priority Data

Sep. 22, 1982 [JP] Japan ..... 57-163883

[51] Int. Cl.[4] ..... C10L 5/16

[52] U.S. Cl. ..... 44/23; 44/10 C; 44/10 F; 201/5; 201/20; 201/22; 201/6

[58] Field of Search ..... 44/23, 24, 1 F, 10 C, 44/19, 15 E; 201/5, 6, 20, 21, 22, 23

[56] References Cited

U.S. PATENT DOCUMENTS

| | | | |
|---|---|---|---|
| 4,097,245 | 6/1978 | Holowaty | 44/23 |
| 4,133,647 | 1/1979 | Burke | 44/24 |
| 4,153,419 | 5/1979 | Clayfield et al. | 44/23 |
| 4,234,320 | 11/1980 | Verschuur | 44/23 |
| 4,272,324 | 6/1981 | Sunami et al. | 44/23 |
| 4,294,584 | 10/1981 | Verschuur | 44/23 |
| 4,362,532 | 12/1982 | Wasson et al. | 44/23 |
| 4,389,306 | 6/1983 | Nakanishi et al. | 44/24 |
| 4,455,148 | 6/1984 | Nagata et al. | 44/24 |
| 4,461,627 | 7/1984 | Yokoyama et al. | 44/23 |

*Primary Examiner*—D. E. Gantz
*Assistant Examiner*—Anthony McFarlane
*Attorney, Agent, or Firm*—Antonelli, Terry & Wands

[57] ABSTRACT

A upgrading method of low-rank coal containing higher ash and moisture contents into coal decreased in ash content and decreased in moisture content and heightened in heating value includes subjecting the low-rank coal to a low-temperature dry distillation treatment, pulverizing the dry-distilled low-rank coal to form a coal-water slurry and adding a binder to the slurry to effect oil agglomeration of the coal and promote separation of the ash.

11 Claims, 1 Drawing Figure

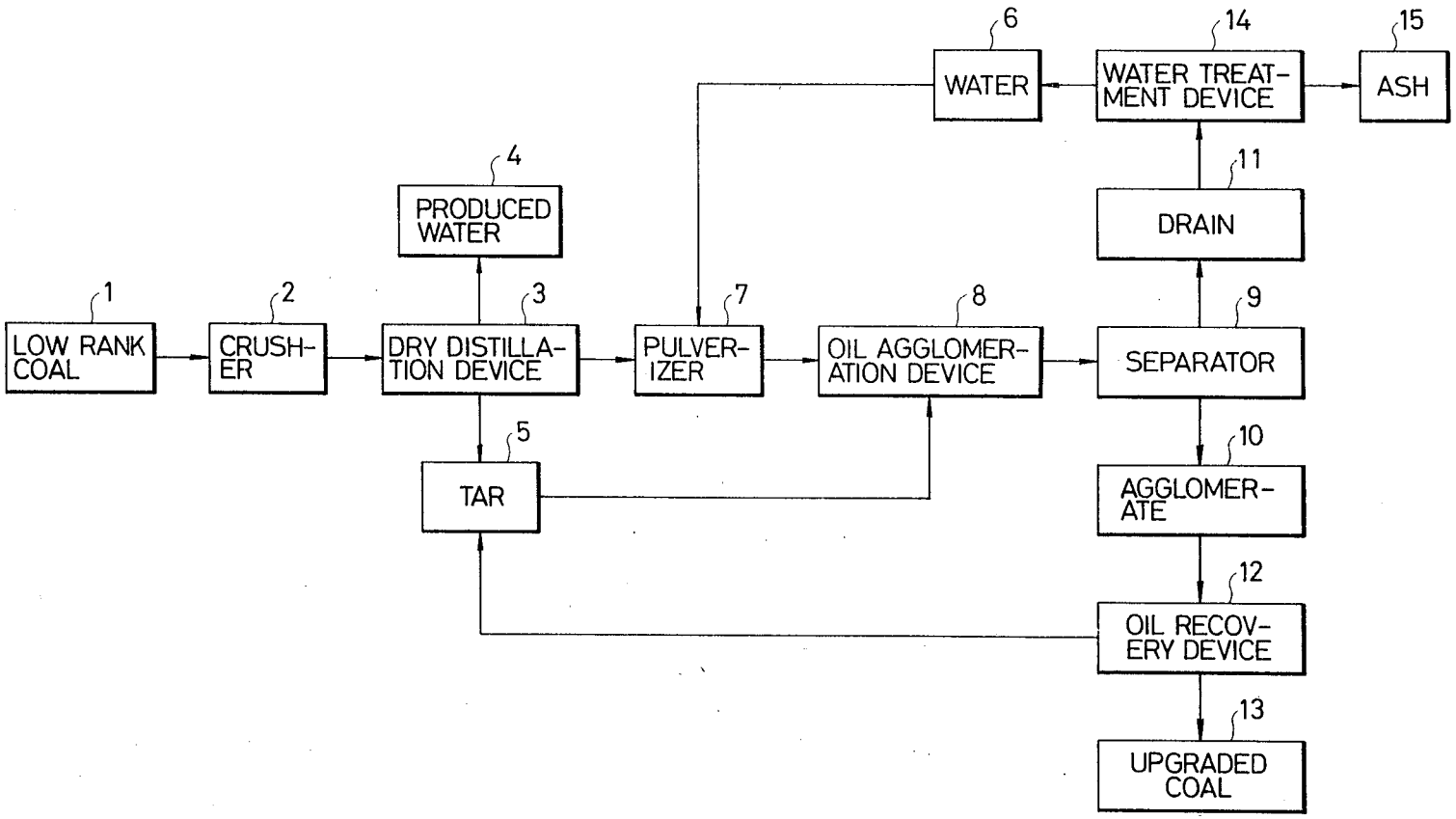
1
LOW RANK COAL
2
CRUSH-ER
3
DRY DISTILLA-TION DEVICE
4
PRODUCED WATER
5
TAR
6
WATER
7
PULVER-IZER
8
OIL AGGLOMER-ATION DEVICE
9
SEPARATOR
10
AGGLOMER-ATE
11
DRAIN
12
OIL RECOV-ERY DEVICE
13
UPGRADED COAL
14
WATER TREAT-MENT DEVICE
15
ASH

UPGRADING METHOD OF LOW-RANK COAL

BACKGROUND OF THE INVENTION

1. Field of the Invention

This invention relates to an upgrading method of low-rank coal and, particularly, relates to a method for upgrading low-rank coal having higher ash and moisture contents to provide coal having a heightened heating value.

2. Description of the Prior Art

Most of coals which have heretofore been used widely as fuel or the like are high-rank coals such as bituminous coal. On the other hand, although low-rank coal accounts for about one fourth of the total of coal existing on the earth, it has not yet been utilized fully and effectively because of its low heating value as fuel; that is, it has a low heating value because of its higher ash and moisture contents and, when burned in a boiler or the like, a phenomenon of marked abrasion on the boiler tubes occurs. Accordingly, in order to provide effective utilization of such low-rank coal as fuel or the like, it becomes important to decrease the ash and moisture contents and thereby to upgrade the coal into coal having a greater heating value.

As a method of decreasing the ash content of coal, there is a conventional coal preparation method. This method, however, has a drawback that the recovery ratio of coal is low. Accordingly, an oil agglomeration method has recently been proposed which can decrease the ash content of coal and, at the same time, provide a markedly high recovery ratio of the coal. This method comprises the steps of pulverizing coal, slurrying the pulverized coal in a liquid medium such as water, then adding a binder for coal to this slurry and mixing the slurry under agitation to effect flocculation and agglomeration of the coal to form agglomerates. In such a process, ash which is hydrophilic is separated from coal in the flocculation and agglomeration steps and, consequently, the ash content of coal can be decreased and, in addition, markedly high recovery ratio of coal can be achieved because the coal is recovered in the form of agglomerates. Accordingly, the inventors of this invention have conducted such a method on low-rank coal having an ash content of more than 20% (based on wet coal) and a moisture content of more than 20% (based on wet coal). The term "wet coal" means the as received coal from a mine, therefore, wet coal contains the surface moisture (or free moisture) and inherent moisture (or equilibrium moisture). So the term "based on wet coal" means "as received basis." As a result, it has been found that, in case of such low-rank coal, no agglomerates can be formed and, further, separation of ash from coal does not occur as is quite different from the case of high-rank coal.

SUMMARY OF THE INVENTION

An object of this invention is to provide an upgrading method of low-rank coal whereby the ash content of the low-rank coal having high ash and moisture conents is decreased and, in connection with this, the moisture content is decreased to upgrade the coal into coal having an increased heating value.

This invention resides in a method of upgrading low-rank coal having higher ash and moisture contents into coal which is decreased in ash content and, in connection with this, decreased in moisture content, which comprises subjecting the low-rank coal to a low-temperature dry distillation treatment, pulverizing the resulting product; i.e., the low-rank coal subjected to the dry distillation treatment, converting the pulverized coal into a coal-water slurry and adding a binder to the slurry to effect agglomeration of the coal.

DESCRIPTION OF THE DRAWING

The attached drawing is a process flowsheet showing an example of the upgrading method for low-rank coal according to this invention.

DESCRIPTION OF THE PREFERRED EMBODIMENTS

Low-rank coal herein-mentioned refers to coal which has an ash content of more than 20% (based on wet coal) and a moisture content of more than 20% (based on wet coal).

An embodiment of this invention is illustrated with reference to the drawing.

In the drawing, low-rank coal 1 supplied, for example, from a mine is crushed in a crusher 2 and fed to a dry distillation device 3 where the coal is subjected to a low-temperature dry distillation treatment. In this treatment, produced water 4 and tar 5 are obtained. The low-rank coal subjected to the low-temperature dry distillation treatment (hereinafter, abbreviated as dry-distilled coal) together with water 6 is fed to a pulverizer 7 where it is pulverized to form a coal-water slurry which, maintained in this state, is then fed to an oil agglomeration device 8. On the other hand, a binder, for example, tar 5, is fed separately to the oil agglomeration device 8 and added to the coal-water slurry. The coal-water slurry to which the tar 5 has been added is mixed under agitation in the oil agglomeration device 8, whereby the coal is flocculated and agglomerated and, finally, formed into agglomerates. These agglomerates together with water are fed from the oil agglomeration device 8 to a separator 9 such as a vibrating screen, where the mixture is separated into agglomerates 10 and drain 11. The separated agglomerates 10 are then fed from the separator 9 to, for example, an oil recovery device 12 where part of the oil is recovered from the agglomerates and, at the same time, the agglomerates are dewatered. As a result, the low-rank coal 1 forms upgraded coal 13 which is decreased in ash content and, in connection with this, decreased in moisture content and heightened in heating value. On the other hand, the oil recovered from the agglomerates in the oil recovery device 12 is used as a binder together with tar 5. The heating temperature of the agglomerates 10 in the oil recovery device 12 is selected to be a temperature below the dry distillation temperature, because the required amount of tar for the oil agglomeration is prepared from this recovered tar and the tar produced by dry distillation. That is, the necessary amount of tar obtained by recovery is calculated by the decrease from the necessary amount tar for oil agglomeration to the amount of produced tar by dry distillation.

Also, if the oil is completely recovered from the agglomerates, the absorption of moisture becomes somewhat low and the agglomerates become easily pulverizable. In case of heating the agglomerates 10 in the oil recovery device 12, the pressure is selected to be an atmospheric pressure or a slightly negative pressure so that the recovery of oil at the same heating temperature can be promoted. On the other hand, the drain 11 is separated into ash 15 and water 6 in a water treatment device 14 utilizing flucculation, sedimentation of the like, and this water 6 is reutilized as water to prepare the coal-water slurry.

As described above, the aim of the process of this invention is to reduce hydrophilicity of the coal by a low-temperature dry distillation treatment of the strong hydrophilic low-rank coal having higher ash and moisture contents and apply an oil agglomeration method to the dry-distilled coal, and at the same time, to control the extent of influence of the tar upon ash separation because, in the course of the low-temperature dry distillation treatment, the tar which is distilled from low-rank coal has the effect of preventing the ash from being separated from the coal during the oil agglomeration treatment. In this respect, a detailed description is hereinafter provided.

In this case, in order to decrease the ash content of the low-rank coal, it is important to control properly the particle size of the low-rank coal and the dry distillation temperature in the low-temperature dry distillation treatment.

First, the particle size of the low-rank coal in the low-temperature dry distillation treatment is controlled to have an average particle size of larger than 0.2 mm, preferably larger than 1.0 mm. This is because, when low-rank coal having an average particle size of below 0.2 mm is subjected to a low-temperature dry distillation treatment in the large quantity treatment on an industrial scale, part of the tar which is distilled by this treatment liquifies and adheres, upon cooling, to the surface of the ash, rendering the ash apparently oleophilic, and further because, when the dry-distilled coal is then pulverized, exposure of tar adhesion-free surfaces is small since the particle size in the low-temperature dry distillation is small and, therefore, when the dry-distilled coal is subjected to the oil agglomeration treatment, the ash flocculates and agglomerates together with the coal, with a consequent little decrease in ash content. In contrast with this, when the particle size of low-rank coal in the low-temperature dry distillation treatment is selected to have an average particle size of larger than 0.2 mm, more tar adhesion-free surfaces are exposed when the dry-distilled coal is pulverized. Thus, it becomes possible to prevent the ash from being rendered apparently oleophilic and, consequently, to decrease the ash content. Moreover, when the average particle size of the low-rank coal in the low-temperature dry distillation treatment is selected to be larger than 1.0 mm, it becomes possible to prevent further the ash from being rendered apparently oleophilic and, as a result, to decrease the ash content further.

The maximum particle size in the dry distillation is not specified. This is because the particle size of coal supplied from a mine is usually smaller than 50 mm and the use of low-rank coal having such a particle size does not give rise to any specific trouble in upgrading the low-rank coal into coal having a heightened or increased heating value. Accordingly, only when the particle size of low-rank coal exceeds 50 mm, the low-rank coal is crushed in a crusher as described above. The particle size of coal which is dry distilled and then pulverized is adjusted, in this case, such that 70 to 80% of the coal has a particle size usually required in the combustion of pulverized coal, that is, below 200 mesh.

The temperature in the low-temperature dry distillation treatment is controlled within the range of 250° to 500° C. This is because, when the temperature is below 250° C. in the dry distillation treatment under an atmospheric pressure, decomposition of oxygen-containing functional groups in a coal structure contained in quantity in the low-rank coal does not occur; whereas when it exceess 500° C., not only the tar distilled from the low-rank coal by dry distillation is decomposed and forms gases such as hydrogen, carbon dioxide and methane, which makes it impossible to utilize the tar as a binder effectively, but also such a high temperature is thermally uneconomical. In view of the recovery of tar distilled from the low-rank coal by dry distillation and construction materials for a dry distillation device, it is preferred to control the temperature in the low-temperature dry distillation to fall in the range of 300° to 400° C.

Although, in the example hereinafter described, produced tar and oil recovered from agglomerates are used as a binder it is also possible to use, as a binder, an emulsion comprising produced tar, oil recovered from agglomerated coal water and a surfactant; e.g., ionic, cationic, anionic, nonionic, or amphoionic surfactants. It is also possible to use other hydrocarbon fuels; e.g., heavy oil, light oil, pitch, coal tar and others. Moreover, it is also possible to discharge the waste water separated from agglomerates in a separator directly out of the system.

EXAMPLE 1

In this example, 1 kg of low-rank coal with a composition of 29.5% ash, 22.5% moisture, 24.0% volatile matter, and 24.0% fixed carbon, a heating value of 3,040 kcal/kg, a maximum particle size of 50 mm and an average particle size of 8.0 mm, was processed in the manner shown in the accompanying drawing. Initially, the low-rank coal was subjected to a low-temperature dry distillation treatment at a temperature of 400° C. for 1 hour under an atmospheric pressure in a nitrogen gas, i.e., an inert gas atmosphere in a dry distillation device 3. By this treatment, 32 g of tar, 312 g of produced water and 612 g of dry-distilled coal were obtained. Then, 612 g of the dry-distilled coal and 1,428 g of water were placed in a ball mill serving as a pulverizer 7, and the mixture was treated so that the dry-distilled coal could be pulverized to particles, of which 80% have a particle size below 200 mesh, and converted into a coal-water slurry. This slurry was fed to an oil agglomeration device 8, while 135 g of tar which had been distilled by a previous low-temperature dry distillation was fed to the oil agglomeration device separately and added as a binder to the coal-water slurry. Then, the slurry to which the tar had been added was agitated at a peripheral speed of 5.0 m/sec in the oil agglomeration device and converted into agglomerates. Then, these agglomerates together with the resulting liquid drain were fed to a vibrating screen acting as a separator 9 and having an opening of 0.5 mm, where the agglomerates were separated from the drain. The agglomerates had a particle size of approximately 2 mm, and the recovery ratio of agglomerates was 99.5%. Then, the agglomerates were heated to 350° C. in an oil recovery device 12 in order to dewater and, at the same time, to recover 98 g of the oil. As a result, the low-rank coal could be upgraded into coal having a decreased ash content of 15.8% (deashing rate 46.4%), a decreased moisture content of 6.81% and a heightened heating value of 5.460 kcal/kg.

Herein, the recovery ratio of agglomerates was determined according to equation (1), and the deashing ratio according to equation (2) is as follows:

$$\text{recovery ratio} = \frac{\text{weight of agglomerates having a particle size} \geqq 0.5\text{ mm}}{\text{total weight of agglomerates}} \times 100\% \quad (1)$$

$$\text{deashing ratio} = \frac{\text{(ash content before low-temperature dry distillation)} - \text{(ash content after oil agglomeration and recovery)}}{\text{ash content before low-temperature dry distillation}} \times 100\% \quad (2)$$

EXAMPLE 2

The same kind of low-rank coal as that in Example 1 was used. This coal was subjected to the same treatments as those in Example 1 except that it was further ground initially to a powder having a maximum particle size of 5.0 mm and an average particle size of 0.7 mm before the low-temperature dry distillation treatment. As a result, the low-rank coal could be upgraded into coal having a decreased ash content of 18.7% (deashing ratio 36.6%), a decreased moisture content of 8.0% and a heightened heating value of 4,910 kcal/kg. The recovery ratio of agglomerates in this case was as high as that in Example 1.

EXAMPLE 3

The same kind of low-rank coal as that in Example 1 was used. This coal was subjected to the same treatments as those in Example 1 except that it was further ground initially into a powder having a maximum particle size of 1.5 mm and an average particle size of 0.15 mm. As a result, the deashing ratio was markedly decreased to 4.3% and, consequently, the heating value could only be increased to 3.965 kcal/kg. The recovery ratio of agglomerates was as high as that in Example 1.

EXAMPLE 4

The same kind of low-rank coal as that in Example 1 was used. This coal was subjected to the same treatments as those in Example 1 except that it was further ground initially into a powder having a maximum particle size of 0.35 mm and an average particle size of 0.045 mm. As a result, separation of the ash could hardly be done though agglomerates were formed. The recovery ratio of agglomerates in this case was as high as that in Example 1.

EXAMPLE 5

The same kind of low-rank coal as that in Example 1 was used. This coal was subjected to the same treatments as those in Example 1 except that it was subjected to a low-temperature dry distillation treatment at a temperature of 300° C. As a result, the low-rank coal could be upgraded into coal having a decreased ash content of 20.5% (deashing ratio 30.5%) a decreased moisture content of 8.2% and a heightened heating value of 4,550 kcal/kg. The recovery ratio of agglomerates in this case was 94.2%.

EXAMPLE 6

The same kind of low-rank coal as that in Example 1 was used. This coal was subjected to the same treatments as those in Example 1 except that it was subjected to a low-temperature dry distillation treatment at a temperature of 250° C. As a result, the low-rank coal could be upgraded into coal having a decreased ash content of 22.2% (deashing ratio 24.7%), a decreased moisture content of 10.6% and a heightened heating value of 4,140 kcal/kg. The recovery ratio of agglomerates in this case was 90.4%.

EXAMPLE 7

The same kind of low-rank coal as that in Example 1 was used. This coal was subjected to the same treatments as those in Example 1 except that it was subjected to a low-temperature dry distillation treatment at a temperature of 200° C. As a result, no agglomerates were formed in this case.

EXAMPLE 8

The same kind of low-rank coal as that in Example 1 was used. This coal was subjected to the same treatments as those in Example 1 except that the dry-distilled coal was pulverized such that 70% of the obtained powder has a size below 200 mesh. As a result, the low-rank coal could be upgraded with almost the same results as in Example 1.

As described above, since this invention consists in a process comprising the steps of subjecting low-rank coal to a low-temperature dry distillation treatment, pulverizing the dry-distilled coal to form a coal-water slurry and adding a binder to the slurry to effect oil agglomeration of the coal, it has an effect of upgrading low-rank coal having higher ash and moisture contents into coal decreased in ash content and, in connection with this, decreased in moisture content and heightened in heating value.

It will be appreciated from the foregoing description that the amount of binder, e.g., tar obtained by dry distillation of coal, admixed with the slurry is from 15 to 40 wt. % based on the weight of the dry-distilled coal. Also, the amount of water admixed with dry-distilled coal to produce the slurry during pulverization is from 40 to 90 wt. % of the dry-distilled coal.

It will be further appreciated that the time for oil agglomeration depends on the peripheral speed of the agitator and, in general, it takes between 30 minutes and 60 minutes. Furthermore, the peripheral speed of the agitator is over 1.0 m/sec and preferably on the order of 5.0 m/sec or more. The range of average particle size of the resultant agglomerates is between about 0.5 mm and about 4.0 mm; e.g., a particle size of about 1.8 mm under the condition of the binder amount being 22%, the peripheral speed being 5.0 m/sec and an oil agglomeration time of 40 minutes using recovered tar as a binder as in Example 1.

What is claimed is:

1. A process for upgrading low-rank coal comprising the steps of subjecting a low-rank coal having an average particle size larger than 0.2 mm to a dry distillation treatment at atmospheric pressure and at temperatures of from 250° to 500° C., finely pulverizing the dry-distilled coal, forming a coal-water slurry by adding water to the finely pulverized coal, and then effecting oil agglomeration of the coal by adding a hydrocarbon fuel as a binder to said slurry thereby promoting separation of ash from the coal.

2. A process for upgrading low-rank coal according to claim 1, wherein said low-rank coal is a coal having an ash content of higher than 20% (based on wet coal), and a moisture content of higher than 20% (based on wet coal).

3. A process for upgrading low-rank coal according to claim 1, wherein the particle size of said low-rank coal which is subjected to said low-temperature dry distillation treatment is adjusted to have an average particle size of larger than 1.0 mm, and, the dry-distilled coal is pulverized such that 70 to 80% of the obtained powder has a particle size below 200 mesh.

4. A process for upgrading low-rank coal according to claim 1, wherein the hydrocarbon fuel used as a binder comprises tar which is produced from said low-rank coal by the dry distillation treatment and oil which is recovered from the agglomerates formed by said oil agglomeration.

5. A process according to claim 3, wherein the particle size of the low-rank coal is adjusted to have an average particle size of larger than 1.0 mm.

6. A process according to claim 1, wherein the dry distillation treatment is effected at a temperature between 300° and 400° C.

7. A process for upgrading low-rank coal according to claim 1, wherein dry-distilled coal is finely pulverized such that 70 to 80% of the obtained powder has a particle size below 200 mesh.

8. A process for upgrading low-rank coal according to claim 7, wherein the amount of water admixed with the dry-distilled coal to produce the slurry is from 40 to 90 wt. % and the amount of binder admixed with the slurry is from 15 to 40 wt. % based on the weight of the dry-distilled coal.

9. A process for upgrading low-rank coal according to claim 8, wherein the oil agglomeration is effected for a period of time of from 30 to 60 minutes with agitation using an agitator operating at a peripheral speed of over 1.0 m/sec.

10. A process for upgrading low-rank coal according to claim 9, wherein said low-rank coal is a coal having an ash content of higher than 20% (based on wet coal), and a moisture content of higher than 20% (based on wet coal).

11. A process for upgrading low-rank coal according to claim 1, further comprising feeding agglomerates of the coal and water from the oil agglomeration in an agitator equipped apparatus to a separator wherein the agglomerates are separated from the water, thereafter the separated agglomerates are fed to an oil recovery device wherein a part of the oil formed during the dry distillation treatment is recovered from the agglomerates and, at the same time, the agglomerates are dewatered to provide an upgraded coal having a reduced ash content and returning the oil separated from the agglomerates to be used as a binder together with tar produced during the dry distillation treatment.

* * * * *